United States Patent [19]

Das et al.

[11] 4,259,161

[45] Mar. 31, 1981

[54] PROCESS FOR PRODUCING ALUMINUM AND ELECTRODES FOR BIPOLAR CELL

[75] Inventors: Subodh K. Das, Apollo; Robert L. Coffman, Lower Burrell, both of Pa.

[73] Assignee: Aluminum Company of America, Pittsburgh, Pa.

[21] Appl. No.: 97,437

[22] Filed: Nov. 26, 1979

[51] Int. Cl.[3] ..... C25C 3/06; C25C 7/02

[52] U.S. Cl. ..... 204/67; 204/243 R; 204/290 R; 204/294

[58] Field of Search ..... 204/243 R, 290 R, 291, 204/294, 67, 254, 268, 244, 39

[56] References Cited

U.S. PATENT DOCUMENTS 4,179,345 12/1979 Das ..... 204/67

FOREIGN PATENT DOCUMENTS 1365820 9/1974 United Kingdom ..... 204/290 R

*Primary Examiner*—Howard S. Williams

*Attorney, Agent, or Firm*—Andrew Alexander; Elroy Strickland

[57] ABSTRACT

A carbonaceous electrode for use in a bipolar electrolytic cell is treated on one side with a source of aluminum to form an adherent layer of aluminum carbide thereon. The electrode is arranged in the cell such that on the passage of electrolyzing current the treated surface functions as a cathode. On electrolyzing the cell, chlorine is produced on each anode surface and aluminum is produced on each cathode surface.

12 Claims, 1 Drawing Figure

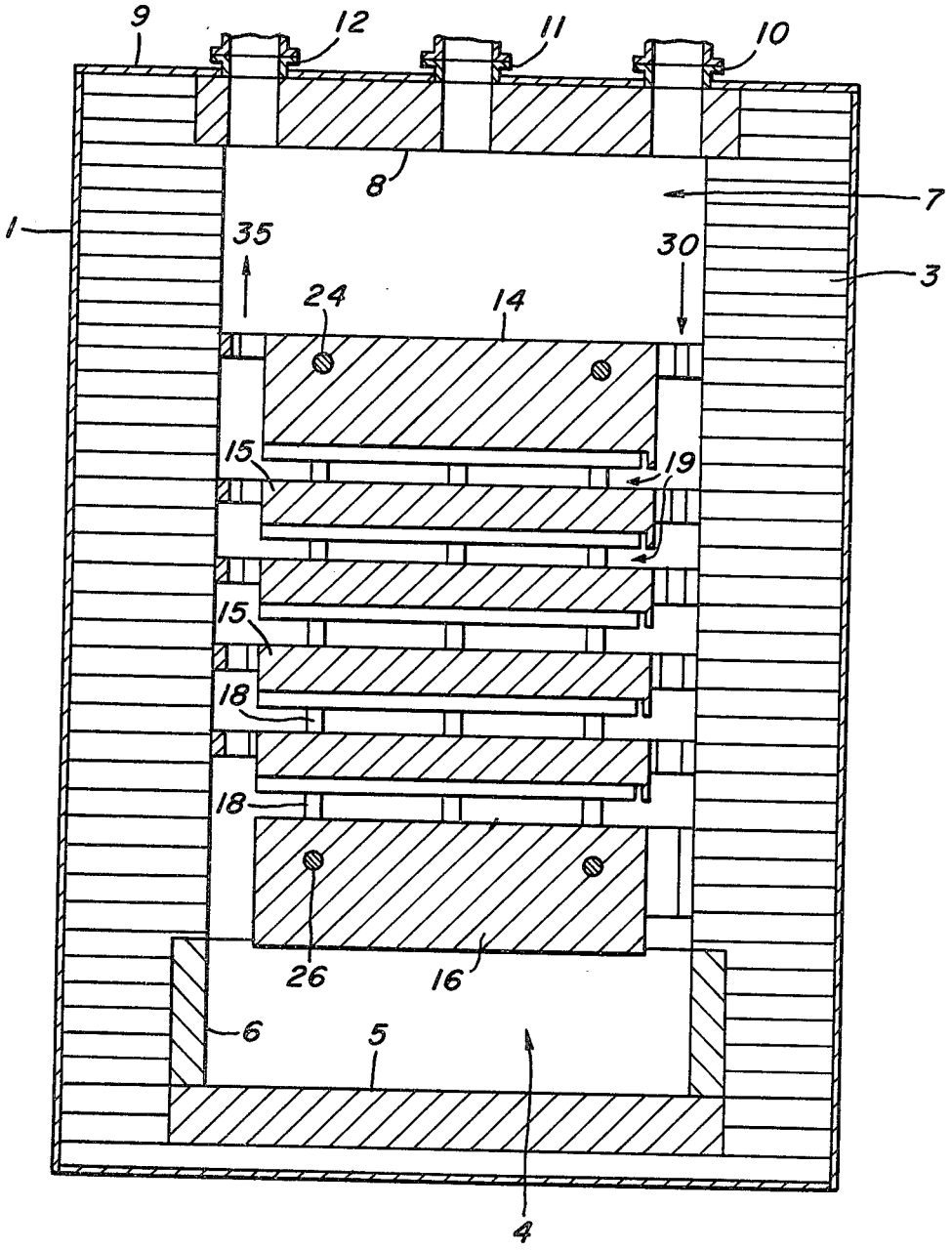
9
12
11
10
8
7
1
35
30
3
24
14
15
19
15
18
18
26
16
6
5
4

PROCESS FOR PRODUCING ALUMINUM AND ELECTRODES FOR BIPOLAR CELL

INTRODUCTION

This invention relates to the production of light metals such as aluminum and magnesium in an electrolytic cell. More particularly, the invention relates to extending the life of carbon electrodes used in an electrolytic cell for the production of metal from its metal chloride.

One type of cell used for the production of light metal from its metal chloride includes an anode, at least one intermediate bipolar electrode and a cathode in superimposed spaced relationship defining interelectrode spaces. The spaces provide for selectively directed bath flow therethrough. Such cell structure is disclosed in U.S. Pat. No. 3,822,195, incorporated herein by reference. However, one of the problems attendant operating such a cell is maintaining a relatively fixed anode-cathode spacing during operation of the cell. The fixed spacing ensures that high current efficiency and power consumption do not change with operation of the cell. The spacing referred to is on the order of less than $\frac{3}{4}$ inch and is disclosed in U.S. Pat. No. 3,755,099, incorporated herein by reference. It should be understood that it is exceptionally difficult to maintain a set spacing with continued use of the cell. For example, as indicated in U.S. Pat. No. 3,725,222, incorporated herein by reference, when the bath contains alkali metal halide or alkaline earth metal halides as the solvent for aluminum chloride, carbonaceous cathodes of the cell are attacked by alkali metal or alkaline earth metal produced by electrolysis of such salts, causing spalling and shrinkage of the cathodes, with attendant change in the anode-cathode distance and increase in maintenance expenses. In addition, particles of carbon end up in the electrolyte and contribute to the formation of sludge at the cathode. Also, it is noted that oxygen reacts with the carbon to form gaseous oxides resulting in consumption of anode carbon which affects the operating characteristics of the cell by deleteriously changing the anode-cathode distance, as well as adding to anode expense. Because of the severity of this problem, extensive research has been conducted to discover means which would further aid in maintaining a desired anode-cathode distance, obviating problems which arise with changes in the anode-cathode distance.

Thus, the present invention provides a method which greatly minimizes changes in anode-cathode distance in a bipolar cell and the problems attendant such changes.

SUMMARY

An object of the present invention is to provide an electrode for use in a cell for producing a light metal from its metal chloride.

Another object of the present invention is to provide a method for production of a light metal from its metal chloride by electrolysis wherein changes in the anode-cathode distance are minimized.

Yet another object of the present invention is to provide a carbonaceous electrode for use in an electrolytic cell for the production of a light metal, the electrode treated so as to minimize changes in the anode-cathode distance upon operation of the cell.

These and other objects will be apparent from the drawing, specification and claims appended hereto.

In accordance with these objects there is provided a process for producing aluminum in an electrolytic cell containing aluminum chloride dissolved in a molten solvent of higher decomposition potential. The cell has a terminal anode, a terminal cathode and at least one bipolar electrode arranged to operate with the anode and the cathode, providing interelectrode spaces therebetween. Chlorine is produced on each anode surface thereof and aluminum on each cathode surface by electrolyzing the cell, the aluminum being swept from the cathode surface by bath material. In the process, carbonaceous material is provided for use as the electrode. The electrode is treated on one side with molten aluminum to provide an adherent layer of aluminum carbide thereon. The electrode is arranged in the cell such that on the passage of electrolyzing current the treated surface becomes cathodic. On electrolyzing the cell, chlorine is produced on each anode surface and aluminum is produced on each cathode surface, the aluminum being swept from the cathode surface.

BRIEF DESCRIPTION OF THE FIGURE

The FIGURE is a sectional elevation illustrative of a cell for producing light metal in accordance with the invention.

DETAILED DESCRIPTION OF THE PREFERRED EMBODIMENTS

Referring to the FIGURE, the cell illustrated includes an outer steel shell 1, which is lined with refractory sidewall and end wall brick 3 made of thermally insulating, electrically nonconductive material which is resistant to molten aluminum chloride-containing halide bath and the decomposition products thereof. The cell cavity accommodates a sump 4 in the lower portion for collecting the aluminum metal produced. The sump bottom 5 and walls 6 are preferably made of graphite. The cell cavity also accommodates a bath reservoir 7 in its upper zone. The cell is enclosed by a refractory roof 8 and a lid 9. A first port 10, extending through the lid 9 and roof 8, provides for insertion of a vacuum tapping tube down into sump 4, through an internal passage to be described later, for removing molten aluminum. A second port 11 provides inlet means for feeding aluminum chloride into the bath. A third port 12 provides outlet means for venting chlorine.

The cell cavity contains a plurality of plate-like electrodes which include an upper terminal anode 14, desirably an appreciable number of bypolar electrodes 15 (four being shown) and a lower terminal cathode 16. These electrodes are arranged in superimposed relation with each electrode preferably being horizontally disposed within a vertical stack. The cathode 16 is supported at each end on sump walls 6. The remaining electrodes are stacked one above the other in a spaced relationship established by interposed refractory pillars 18. Such pillars 18 are sized to closely space the electrodes, as for example to space them with their opposed surfaces separated by less than $\frac{3}{4}$ inch. In the illustrated embodiment, five interelectrode spaces 19 are formed between opposed electrodes, one between cathode 16 and the lowest of the bipolar electrodes 15, three between successive pairs of intermediate bipolar electrodes 15 and one between the highest of the bipolar electrodes 15 and anode 14. Each interelectrode space is bounded by an upper surface of one electrode (which functions as an anode surface) opposite a lower surface of another electrode (which functions as a cathode surface), and the spacing therebetween, e.g. about $\frac{1}{2}$ inch, is referred to herein as the anode-cathode distance (the electrode to electrode distance being the effective anode-cathode distance in the absence of a metal layer of substantial thickness). The bath level in the cell will vary in operation but normally will lie well above the anode 14, thus filling all otherwise unoccupied space therebelow within the cell.

Anode 14 has a plurality of electrode bars 24 inserted therein which serve as positive current leads, and cathode 16 has a plurality of collector bars 26 inserted therein which serve as negative current leads. The bars 24 and 26 extend through the cell wall and are suitably insulated from the steel shell 1.

As noted earlier, the sump 4 is adapted to contain bath and molten aluminum, and the latter may accumulate beneath the bath in the sump during operation. Should it be desired to separately heat the bath and any metal in sump 4, an auxiliary heating circuit may be established therein.

In accordance with the present invention, electrodes for use in a bipolar electrolytic cell are comprised of carbonaceous material and are treated on one side thereof with molten aluminum to form an adherent layer of aluminum carbide thereon. That is, it has been discovered that if a carbonaceous electrode for use in a bipolar cell is treated with molten aluminum to form an adherent aluminum carbide layer or coating thereon the useful life of the electrode can be greatly extended. The extended life permits the production of more metal before the cell has to be adjusted thereby greatly increasing its efficiency. After the layer or coating of aluminum carbide is provided, the electrode is arranged in the cell such that upon passage of an electrolyzing current the side of the electrode having the aluminum carbide coating functions as a cathode. Thus, the aluminum carbide layer provides a protective coating for the carconaceous material forming the electrode and prevents wear of the carbonaceous material by aluminum formed at the cathode surface during electrolysis.

While the inventors do not necessarily wish to be bound by any theory of invention, it is believed that aluminum depositing on a carbonaceous electrode (without a protective coating) during electrolysis forms aluminum carbide that is only very loosely adherent and which spalls more or less on a continuous basis. This of course results in the anode-cathode distance changing making it very difficult to adjust the anode-cathode distance for greatest efficiency. In contrast, by treating the electrode with molten aluminum prior to being used in the cell, it has been discovered that a very tightly adherent layer of aluminum carbide is formed which greatly resists spalling during electrolysis. Thus, change in the anode-cathode distance is greatly reduced and the useful life of the cell is increased considerably.

The carbonaceous electrode can be treated by dipping or spraying one side thereof with molten aluminum, for example. It has been found that commercial purity aluminum, for example, 99.5 wt.% aluminum, is quite suitable. Further, the electrode side should be immersed in the molten aluminum for at least 15 to 60 minutes with greater periods of time being considered to be beneficial. A typical immersion time can be 22 hours. However, longer times can be employed without detrimental effects. Of course, very long periods are less preferred for reasons of economics.

The temperature of the molten aluminum can range from melting point of aluminum or its alloys to 1000° C. with a preferred temperture range being 700° to 950° C. It should be noted that the higher temperatures tend to produce vaporization of the aluminum. Vaporization may be used to deposit aluminum on the electrode but deposits on the anodic side should be avoided since such can unduly accelerate the wear rate of the electrode.

During the treating or dipping operation, preferably exposure of the aluminum carbide layer to air should be minimized. Thus, in a preferred aspect of the invention, an inert gas, e.g. argon, with respect to the aluminum carbide layer should be used during the dipping operation.

Carbonaceous material used for the production of electrodes in accordance with the present invention can be derived from petroleum coke or coke derived from coal. When petroleum coke is used, typically it is calcined initially at a temperature in the range of 800° to 1600° C. and thereafter pitch is added to provide a mix having a pitch content of about 10 to 30 wt.%. The mix is typically extruded to provide carbonaceous members which may then be cut or machined into electrodes. Further, typically the extruded member is quenched, then baked at a temperature in the range of 800° to 1600° C. and treated with pitch to increase its density. Normally, it is then subjected to a final graphitizing temperature in the range of 2000° to 3100° C.

As well as treating the electrode in accordance with the present invention, it is important that the electrode have controlled properties in order to minimize changes in anode-cathode distance. Thus, for purposes of the present invention, the electrode can have a density in the range of 1400 to 2000 kg/m$^3$ with a preferred density in the range of 1550 to 1900. Typically, the density of the material is in the range of 1700 to 1880 kg/m$^3$. In addition, the electrode should have a controlled grain size. That is, for purposes of the present invention, the grain size of the carbonaceous material should be in the range of $1.0\times10^{-6}$ m to $1.0\times10^{-2}$ m with a preferred range being $2.0\times10^{-6}$ m to $6.6\times10^{-3}$ m. Also, it is important that the coefficient of thermal expansion of the grains be controlled so as to be in the range of $1.0\times10^{-6}$ to $7.0\times10^{-6}$ in/in/°C., with a preferred range being $1.5\times10^{-6}$ to $6.0\times10^{-6}$ in/in/°C. The carbon structure should also be controlled to provide a crystallite size in C-direction in the range of 60 to 500 angstroms, with a preferred range being 100 to 450 angstroms. Also, the ash content of carbonaceous material constituting the electrode should be controlled so as to be in the range of 0.0001 to 5.0 wt.% with a highly preferred range being 0.02 to 3.0. The electrical resistivity in the grain flow direction should also be controlled in the range of 1.0 to 50.0 $\mu\Omega$m with the preferred range being 5.0 to 30.0 $\mu\Omega$m. It should be understood that it is important to have the properties of the carbonaceous material constituting the electrode controlled in this way in order to ensure maximum life.

The electrolyte employed for producing light metal in accordance with the subject invention normally will comprise a molten bath composed essentially of aluminum or magnesium chloride dissolved in one or more halides of higher decomposition potential than aluminum chloride. By electrolysis of such a bath, chlorine is produced on the anode surfaces and light metal on the cathode surfaces of the cell electrodes. The metal is conveniently separated by settling from the lighter bath, and the chlorine rises to be vented from the cell. In such practice of the subject invention, the molten bath may be positively circulated through the cell by the buoyant gas lift effect of the internally produced chlorine gas, and light metal chloride is periodically or continuously introduced into the bath to maintain the desired concentration thereof.

The bath compositiion, in addition to the dissolved aluminum or magnesium chloride, will usually be made up of alkali metal chloride although other alkali metal halide and alkaline earth halide may also be employed. A presently preferred aluminum chloride containing composition comprises an alkali metal chloride base composition made up of about 50 to 75 wt.% sodium chloride and 25 to 50 wt.% lithium chloride. Aluminum chloride is dissolved in such halide composition to provide a bath from which aluminum may be produced by electrolysis, and an aluminum chloride content of about 1½ to 10 wt.% of the bath will generally be desirable. As an example, a bath analysis as follows is satisfactory: 53 wt.% NaCl, 40 wt.% LiCl, 0.5 wt.% $MgCl_2$, 0.5 wt.% KCl, 1 wt.% $CaCl_2$ and 5 wt.% $AlCl_3$. In such bath, the chlorides other than NaCl, LiCl and $AlCl_3$ may be regarded as incidental components or impurities. The bath is employed in molten condition, usually at a temperature above that of molten aluminum and in the range between 660° and 730° C., typically at about 700° C. A presently preferred magnesium chloride containing composition comprises about 80 to 98.5 wt.% lithium chloride and about 1.5 to 20 wt.% magnesium chloride.

In addition to treating with molten aluminum, it has been discovered that a protective layer of aluminum carbide can be provided by treating the surface of the electrode with powdered aluminum to provide an adherent layer thereon, the treatment being provided prior to electrolysis. It is believed that the layer of aluminum powder fills the surface pores of the electrode and, upon heating in the cell prior to electrolysis, is converted to provide an adherent, protective layer of aluminum carbide. Typically, powdered aluminum of commercial purity, e.g. greater than 99.0 wt.% aluminum, may be used. However, it is believed that aluminum of lesser purity may also be used without adverse results. Preferably, the powder should have a purity greater than 99.5 wt.%. In a preferred embodiment, the aluminum powder should be selected to contain not more than 5 wt.% aluminum oxide and preferably not more than 1 wt.% aluminum oxides, with a typical oxide concentration being in the range of 0.1 to 0.8 wt.%. It is preferred that the powder have a generally round or spherical configuration and have a density of about 0.5 to 1.5 grams/cc with a typical density being about 0.8 grams/cc.

It will be understood that the electrodes of the present invention may be used as anodes, cathodes or bipolar electrodes. Also, it should be noted that it is normally only necessary to use the electrodes as cathodes and bipolar electrodes in order to realize the benefit of the present invention.

The following examples are still further illustrative of the invention.

EXAMPLE 1

One side of a graphite electrode having a thickness of 16 mm was immersed in molten aluminum at a temperature of 750° C. for a period of 22 hours, the molten aluminum being 99.5 wt.% pure. The electrode was then tested in a cell having a bath composition comprising 65 wt.% NaCl, 28 wt.% LiCl and 7% $AlCl_3$. The cell was operated at a temperature of 710° C. for a period of 65 hours at a current density of 8 amps/in$^2$. A similar electrode not treated with molten aluminum was tested under the same conditions. The electrodes were cleaned of electrolyte and their dimension with respect to thickness measured. The electrode which was not treated had a dimensional loss of 0.062 mm. The electrode treated as above had a loss of only 0.017 mm. Thus, it can be seen that the untreated electrode had a wear rate of three times greater than the treated electrode. That is, the treated specimen would have a useful life over three times longer than the untreated specimen.

EXAMPLE 2

A second electrode was treated as above except the temperature of the molten aluminum was 950° C. and the treatment was for a period of 24 hours. The treated specimen was tested in a cell substantially as described above and after cleaning it had a dimensional loss of 0.017 mm. Thus, again it was found that the treated specimen had a useful life of over three times greater than the untreated specimen.

EXAMPLE 3

A third electrode was treated with powdered aluminum at room temperature to provide an adherent coating thereon. 75 to 90% of the powder used passed through a 325 mesh screen (Tyler Series). The electrode was then placed in an electrolytic cell, heated to above the melting point of the powdered aluminum (about 710° C.) and then tested as in Example 1 above. The treated specimen had only a loss of 0.017 mm, which showed a substantial improvement in the wear rate. It will be understood that applying powder has the advantages of minimizing time for applying the coating. Further, the powdered coating can be applied at room temperature and provide the same reduction in wear rate.

Thus, it can be seen that a treatment in accordance with the present invention greatly increases the efficiency of a bipolar cell by extending the useful life of the electrodes.

While the invention has been described in terms of preferred embodiments, the claims appended hereto are intended to encompass other embodiments which fall within the spirit of the invention.

What is claimed is:

1. A method for producing aluminum in an electrolytic cell containing aluminum chloride dissolved in a molten solvent of higher decomposition potential, the cell having a terminal anode, a terminal cathode and at least one bipolar electrode arranged to operate with the anode and the cathode providing inter-electrode spaces therebetween, the process which comprises the steps of:

(a) providing at least one bipolar electrode comprised of carbonaceous material;

(b) treating one surface of the electrode with a source of aluminum to provide an adherent layer of aluminum carbide thereon;

(c) arranging the electrode in the cell so that the treated surface functions as a cathode on passage of electrolyzing current; and (d) thereafter electrolyzing the cell, thereby producing chlorine on each anode surface and aluminum on each cathode surface, the aluminum being swept from the cathode surface by bath material.

2. The method in accordance with claim 1 wherein molten aluminum is employed for treating the electrode for a period of at least 15 to 60 minutes, the aluminum having a temperature in the range of 700° to 950° C.

3. The method according to claim 1 wherein the treatment is for at least a period of 15 to 60 minutes.

4. The method according to claim 1 wherein the treating is performed in an atmosphere inert with respect to aluminum carbide.

5. The method according to claim 1 wherein the electrode has a density in the range of 1400 to 2000 $kg/m^3$.

6. The method in accordance with claim 1 wherein the carbonaceous material in the electrode has a grain size in the range of $1.0\times10^{-6}$ to $1.0\times10^{-2}$ m.

7. The method in accordance with claim 1 wherein the carbonaceous material has an ash content in the range of 0.02 to 2.15 wt.%.

8. A method for producing aluminum in an electrolytic cell containing aluminum chloride dissolved in a molten solvent of higher decomposition potential, the cell having a terminal anode, a terminal cathode and at least one bipolar electrode arranged to operate with the anode and the cathode providing inter-electrode spaces therebetween, the process which comprises the steps of:

(a) providing at least one bipolar electrode comprised of a carbonaceous material having a density of 1400 to 2000 $kg/m^3$, a grain size in the range of $2.0\times10^{-6}$ to $6.6\times10^{-3}$ m, and an ash content in the range of 0.02 to 2.15 wt.%;

(b) treating one surface of the electrode with molten aluminum at a temperature in the range of 700° to 950° C. for a period of at least 15 to 60 minutes to provide an adherent layer of aluminum carbide thereon;

(c) arranging the electrode in the cell so that the treated surface functions as a cathode on passage of electrolyzing current; and (d) electrolyzing the cell thereby producing chlorine on each anode surface and aluminum on each cathode surface.

9. In an improved cell for the production of aluminum from aluminum chloride dissolved in a molten solvent of higher decomposition potential, the cell having a terminal anode and a terminal cathode, the improvement comprising at least one bipolar electrode arranged to operate with the anode and cathode providing inter-electrode spaces therebetween, the bipolar electrode formed from a carbonaceous material and having one surface thereof treated with molten aluminum for a period of at least 15 to 60 minutes to provide an adherent layer of aluminum carbide thereon, the electrode arranged in the cell so that the treated surface functions as a cathode during the passage of an electrolyzing current through the cell.

10. An improved bipolar electrode for use in an electrolytic cell having a terminal anode and a terminal cathode for the production of aluminum from aluminum chloride dissolved in a molten solvent, the improvement comprising the bipolar electrode being formed from a carbonaceous material and having one surface thereof treated with molten aluminum for at least 15 to 60 minutes to provide an adherent layer of aluminum carbide thereon to function as a cathode.

11. The electrode according to claim 10 wherein the carbonaceous material has a density in the range of 1400 to 2000 $kg/m^3$.

12. The electrode according to claim 10 wherein the carbonaceous material has a grain size in the range of $1.0\times10^{-6}$ to $1.0\times10^{-2}$ m.

* * * * *